United States Patent [19]

McBride

[11] 4,121,823

[45] Oct. 24, 1978

[54] EDUCATIONAL DEVICE EMPLOYING A GAME SITUATION

[76] Inventor: Tarrie A. McBride, 1109 W. 24th, No. 3, San Pedro, Calif. 90731

[21] Appl. No.: 753,230

[22] Filed: Dec. 22, 1976

[51] Int. Cl.[2] ..... A63F 3/00

[52] U.S. Cl. ..... 273/249; 35/23 R; 273/243

[58] Field of Search ..... 35/23 R, 21, 31 G, 9 R; 273/134 C, 134 D, 134 E, 134 BD, 134 ER, 134 GP, 134 AD, 242, 243, 249

[56] References Cited

U.S. PATENT DOCUMENTS

| | | | |
|---|---|---|---|
| 3,104,106 | 9/1963 | Kenney et al. | 273/134 C |
| 3,734,508 | 5/1973 | Snyder | 273/134 C |
| 3,741,546 | 6/1973 | Chen | 273/134 C X |
| 3,759,520 | 9/1973 | Straitwell | 273/134 C X |
| 3,815,919 | 6/1974 | Cain et al. | 273/134 D X |
| 3,831,946 | 8/1974 | Denalsky | 273/134 E X |

*Primary Examiner*—William H. Grieb
*Attorney, Agent, or Firm*—Lyon & Lyon

[57] ABSTRACT

An educational device employing a game situation to teach a preselected, and particularly religious, subject matter is disclosed. The educational device is generally comprised of a playing board having a plurality of contiguous areas extending around the perimeter of the playing board. The contiguous areas are divided into a plurality of subject matter areas, each subject matter area having associated therewith a deck of cards. Most of the cards have printed thereon questions regarding the subject matter of study, although some card decks specifically direct the player. The object of the game is to advance around the perimeter of the board, through the contiguous areas. In each turn a player advances initially in accordance with a chance device, and thereafter by answering questions or following other instructions from the card deck associated with the area on which the player lands.

5 Claims, 2 Drawing Figures

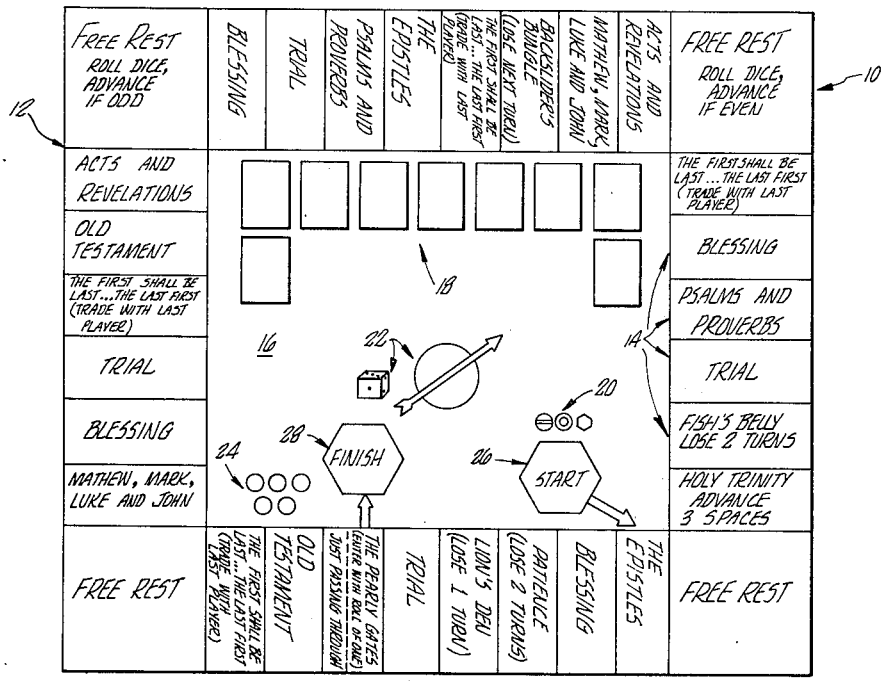

EDUCATIONAL DEVICE EMPLOYING A GAME SITUATION

FIELD OF THE INVENTION

This invention relates to educational devices, and more specifically to educational devices employing game situations to teach various subject matter, especially religious subject matter.

BACKGROUND OF THE INVENTION

Educational devices for teaching various subject matter have been in use for many years. In most cases, such educational devices have employed flash cards, tables, and other similar devices. Such prior art educational devices are primarily concerned with a single subject matter, and provide nothing in the way of entertainment or competition between various persons. Thus, for the most part, children and adults alike quickly became bored with such devices.

Further, since such prior art educational devices are primarily concerned with only a single subject matter, and cannot readily be changed to expand the teachings in the subject, nor be expanded to other subject matter areas, such devices are of limited educational benefit.

Accordingly, it is one object of the present invention to provide an educational device employing a game situation to teach selected subject matters, specifically religious subject matter.

It is a further object of the present invention to provide an entertaining and educational game apparatus.

It is a further object of the present invention to provide a game apparatus for teaching religious doctrine.

It is another object of the present invention to provide an educational device allowing for competition between two or more persons.

It is still another object of the present invention to provide an inexpensive educational device for teaching a plurality of subject matter areas.

Other and further objects of the present invention will become apparent from the course of the following detailed description.

SUMMARY OF THE INVENTION

The present invention provides an educational device employing a game situation to teach various subject matter. In a preferred embodiment, religious subject matter is taught. The educational device is typically comprised of a playing board having a plurality of contiguous areas located around the perimeter thereof, a plurality of card decks, a plurality of markers, and chance means that may be sequentially operated by the players of the educational device. The contiguous areas are divided into a plurality of different subject matter categories, with each side of a preferably rectangular game board having a variety of such subject matter categories located thereon.

Associated with each category of contiguous areas, except the corner areas, is a deck of cards. For a plurality of the categories of contiguous areas, each card in the deck bears a question and the answer thereto. The card decks associated with the remaining categories specifically direct the player's movement.

The object of the game is to travel the entire perimeter of the game board by travelling through the contiguous areas thereon. At each turn, a player initially advances in accordance with a chance device. The chance device will direct the player to one of the contiguous areas. Since most of the contiguous areas have associated therewith a card deck, the player's next move will be directed thereby. If the card deck involved is one of those having questions and answers, the player will be asked the question, and if correctly answered, the player is permitted to advance in accordance with the directions on the card. If the card deck is not of the question-answer type, the player is required to follow the directions on the card. If the player lands on an area not associated with a card deck, the player's turn ends, and he begins with the chance means on his next turn. Typically, the question-answer cards bear questions relating to religious subject matter, although obviously any subject matter may be employed. The object of the game, as noted above, is to travel the perimeter of the board through the contiguous areas, and ultimately to reach a central area of the game board enclosed by the perimeter of contiguous areas.

DESCRIPTION OF THE DRAWINGS

FIG. 1 is a top plan view of a game apparatus in accordance with the present invention.

FIG. 2 illustrates a question-answer card for use with the game apparatus of FIG. 1 in accordance with the present invention.

DETAILED DESCRIPTION OF THE INVENTION

Referring now to FIG. 1, there is shown therein a top plan view of a game apparatus 10 in accordance with the present invention. The game apparatus 10 is generally comprised of a board 12 having around the perimeter thereof a plurality of contiguous areas 14 enclosing a central area 16. The game apparatus 10 further comprises a plurality of card decks 18 associated with the contiguous areas 14 as described hereinafter, markers 20 for each player, a chance device 22 and various markers such as red, blue and white chips 24 as discussed in detail hereinafter. Within the central area 16 is a starting point 26 and a finishing point 28.

As can be seen from the game board 12 shown in FIG. 1, the preferred embodiment of the present invention is directed to the teaching of religious subject matter, although it will be apparent in the course of the following description that the invention may readily be adapted for teaching different subject matter. In the preferred embodiment shown, the contiguous areas 14 forming the perimeter of the game board 12 are divided into a plurality of subject matters extracted from the bible, for example, the Epistles, Old Testament, Matthew, Mark, Luke and John, Acts and Revelations, and Psalms and Proverbs. Associated with each of the above subject matter areas is one of the card decks 18, bearing on each card a question, the answer to the question, and a predetermined number of advances associated with each card, as better illustrated in FIG. 2. Thus, each of the five biblical subject matter areas listed above has associated therewith a card deck, and each card deck bears a question relating to the subject matter of that book of the bible, although in some instances "Pot Luck" questions may be included. Pot Luck questions may be taken from any of the subject matter areas under study; thus, for example, a Pot Luck question in the Eptistles card deck may be derived from the subject matter of the Old Testament.

Certain of the contiguous areas 14 located on the game board 12 bear the indicia "Trial", "Blessing", and "Prayer Closet." Related to each of these categories of contiguous areas 14 is another of the card decks 18; however, these card decks provide specific instructions to the players rather than providing a question and answer. The remainder of the contiguous areas 14 located on the game board 12 bear thereon specific instructions to the player, for example, the "Free Rest" squares located at the corners of the board 12, or those squares marked "Fishes Belly", "Lions Den", "Patience", "The First Shall Be Last . . . And The Last First", "Backsliders Bungle" and "Holy Trinity." An area 14 having no instructions thereon and no card deck associated therewith ends a player's turn, the player being neither penalized nor permitted to advance until the next turn. The final remaining area, shown on board 12 as "The Pearly Gates" is provided as an entry to the central area 16 as discussed in greater detail hereinafter.

To begin play, all card decks 18 should be shuffled and placed in position. Each player should take a marker 20, and also a plurality of the chips 24, specifically three red chips and two blue chips, for use as explained hereinafter. The marker for each player is placed at the starting point 26. Order of play may be determined by any suitable means, for example, sequential operation of the chance means 22.

The starting player begins play by operating the chance means 22 to exit the starting point 26. If the player lands on a biblical square, for example, the Epistles, one of the other players selects from the card deck marked Epistles a single card 30, as illustrated in FIG. 2. The card 30 bears thereon a number of advance points 32, together with a question and answer 34. The questions are typically in multiple choice form, although any suitable form will do.

The player whose turn it is is advised of the number of advance points 32 present on the card 30, and is given the opportunity to either pass, to be described hereinafter, or answer the question. Preferably, the player is advised of the number of advance points 32 prior to being given the question 34 for strategy purposes. For example, the question on the card 30 may be worth two advance points. If the player is located on the square the "Epistles", an advance of two squares would put him on the square "Patience", causing him to lose two turns. Therefore, the player would prefer not to answer the question, in which case he may pass. However, only two passes are permitted per game, and each pass requires that the player pay to the kitty one blue chip 24. In any event, the player may not pass on a square marked "Trial", or any other non-question square.

If the player elects to answer the question, after having been read the number of advance points 32, the question 34 is read and the player is given the opportunity to answer. If the player answers correctly, he is permitted to advance the number of advance points indicated on the card. If the player answers incorrectly, he loses his turn. When it next becomes the same player's turn, he begins play by operation of the chance means 22 as before. If the player answers the question correctly, and again lands on a bibilical square, he is permitted to proceed as above. However, the contiguous areas 14 are arranged to virtually eliminate the possibility of a player going continuously around the board in one turn. Thus, it is almost inevitable that a player will either lose a turn or reach a Free Rest square before completing travel around the outer perimeter, thereby giving other players the opportunity to compete. From the above it can be seen that a player proceeds continuously during each turn until the player lands on a Lose Turn square, is sent to the Prayer Closet, is required to remain at Free Rest either by incorrectly answering a question or other card or square, or is sent back by a card or square.

For the embodiment of the game board 12 illustrated in FIG. 1, the goal of the game is to travel around the perimeter of the game board 12 through the contiguous areas 14 for a total of at least 38 squares. That is, a player begins at Starting Point 26, makes a full circle around the perimeter of the game board 12 and continues past the completion of one lap until the square marked "The Pearly Gates." A roll of the die or other advance directing the player to go beyond The Pearly Gates is truncated to permit the player to stop at that square. To reach the finishing point 28 from The Pearly Gates, a player must either be directed onward by a Rapture card, described hereinafter, or succeed in obtaining a one on the chance means, for example, a one on the die.

The Rapture card described above is one of the cards in the "Blessing" card deck. If a player succeeds in obtaining a Rapture card, he retains the card until needed to enter at The Pearly Gates. Other cards which may be used in the game and should be retained by the player until needed are, for example, "Prayer and Fasting" cards, which nullifies any situation causing the player to go to the Prayer Closet, to be described hereinafter. Also, a "Shield of Faith", also found in the "Blessing" cards, protects a player from having to follow the directions on a "Trial" card should the player land upon a "Trial" square. Another card which should be retained is a Tithe card, which requires that the player Tithe or give up a portion of his advances for the remainder of the game. For example, a Tithe card may require that the player tithe one advance from each move. Thus, if a question were worth five advance points, the player would tithe one and therefore advance only four spaces. Tithing on advance by the chance means is analogous. If a player forgets to tithe for two consecutive turns, he goes to the Prayer Closet.

The "Prayer Closet" referred to above has associated therewith a card deck entitled "Cast Thy Bread", the cards of which specifically direct the player. If a player is in the Prayer Closet, he must explicitly follow the directions of the card from the Cast Thy Bread deck. A player is required to place his marker in the Prayer Closet upon running out of red chips, which are among the markers 24 distributed at the beginning of the game. Typically, a player will be given three red chips, and must pay to the kitty one red chip for each bible question missed. When the player runs out of red chips, he must place his marker 20 in the Prayer Closet, and follow the directions of the card from the Cast Thy Bread deck. Upon exiting the Prayer Closet for failure to answer bible questions, a player is given three more red chips from the kitty; however, should the player enter the Prayer Closet for any other reason, he does not receive more red chips.

The white chips, among the markers 24 discussed above, are used only when a player must travel more than one lap around the game board 12 to complete the game. If such a version of the game is played, a player will receive one white chip for each lap around the board. For example, if two laps are required, the player will be given a white chip upon passing the first square, marked "The Epistles" on the game board 12 shown in FIG. 1. This white chip will be given in trade to another player in last place when the first player lands on a "First Shall Be Last" square, and the player in last place has not as yet received a white chip. Should a version of the game be played involving more than two laps, a greater number of white chips can be distributed, with trading between first and last players being analogous to that described above. It is recommended that for five or more players, the game should comprise only a single lap, plus the advances required to get from the starting square to "The Pearly Gates." However, for fewer than five players a plurality of laps may be desired.

It can be seen from the above that the invention herein disclosed can be used to teach virtually any subject matter area, although the particular embodiment disclosed is directed primarily to teaching religious subject matter. Further, the level of training may be readily adjusted by merely revising the questions on the card decks. Thus the game of the present invention may be directed to a broad range of capabilities, with one version being intended for use with those just beginning to learn a subject area, and another version of the game directed to those having a full knowledge of the subject matter area. It can therefore be seen that the game of the present invention can provide a stimulating learning situation, as well as providing a competitive interest, over a broad range of educational levels and for long periods of time.

Having described the invention, it is to be understood that many variations will be obvious to those skilled in the art without departing from the spirit of the invention herein.

I claim:

1. An educational device comprising a game board having thereon a continuous plurality of contiguous areas, said continuous plurality of contiguous areas being divided into a plurality of categories, a first of said categories having associated therewith a preselected subject matter and a deck of cards, each card in said deck of cards having thereon a question relating to said subject matter and indicia for directing a player's movement about the board upon properly answering said question, wherein said indicia for directing a player's movement about the board upon properly answering a question reflects the degree of difficulty of said question, and chance means for directing a player's movement about the board.

2. An educational device as in claim 1 further comprising a second of said categories of areas having associated therewith a deck of cards specifically directing a player's movement about the board in a manner suitable for reinforcing the subject matter of said game.

3. An educational device as in claim 2 further comprising a third of said categories of areas having thereon indicia for specifically directing a player's movement about the board.

4. An educational device comprising a game board having thereon a continuous plurality of contiguous areas, said continuous plurality of contiguous areas being divided into a plurality of categories, a first of said categories having associated therewith a preselected subject matter and a deck of cards, each card in said deck of cards having thereon a question relating to said subject matter and indicia for directing a player's movement about the board upon properly answering said question, a second of said categories of areas having associated therewith a deck of cards specifically directing a player's movement about the board, a third of said categories of areas having thereon indicia for specifically directing a player's movement about the board, wherein certain of said third category of areas specifically direct the exchange of positions between players, and chance means for directing a player's movement about the board.

5. An educational device comprising a game board having thereon a continuous plurality of contiguous areas, said continuous plurality of contiguous areas being divided into at least first, second and third categories, chance means for directing a player's movement about the board, said first category being divided into a first plurality of subcategories, each subcategory having associated therewith a preselected subject matter and a deck of cards, each card in said deck of cards having thereon a question relating to said subject matter and indicia indicating the number of said contiguous areas a player may advance for properly answering the question on said card, said degree of advancement being related to the degree of difficulty of said question, said second category of contiguous areas being divided into a second plurality of subcategories, each of said subcategories having associated therewith a deck of cards, each card in said deck of cards specifically directing the movement of the player about the board, and said third category of contiguous areas having indicia thereon for directing the movement of the player about the board, certain of said third category of areas specifically directing the exchange of positions between players.

* * * * *